US006957131B2

(12) United States Patent
Kane et al.

(10) Patent No.: US 6,957,131 B2
(45) Date of Patent: Oct. 18, 2005

(54) POSITIVE SIGNAL COMPARATOR AND METHOD

(75) Inventors: Mark Edward Kane, Orange Park, FL (US); James Francis Shockley, Orange Park, FL (US); Harrison Thomas Hickenlooper, Palatka, FL (US)

(73) Assignee: Quantum Engineering, Inc., Orange Park, FL (US)

( * ) Notice: Subject to any disclaimer, the term of this patent is extended or adjusted under 35 U.S.C. 154(b) by 13 days.

(21) Appl. No.: 10/300,852

(22) Filed: Nov. 21, 2002

(65) Prior Publication Data

US 2004/0102877 A1 May 27, 2004

(51) Int. Cl.[7] ..... G05D 1/00
(52) U.S. Cl. ..... 701/19; 701/20
(58) Field of Search ..... 701/19, 20

(56) References Cited

U.S. PATENT DOCUMENTS

| | | | |
|---|---|---|---|
| 4,181,943 | A | 1/1980 | Mercer, Sr. et al. |
| 4,459,668 | A | 7/1984 | Inoue et al. |
| 4,561,057 | A | 12/1985 | Haley, Jr. et al. |
| 4,711,418 | A | 12/1987 | Aver, Jr. et al. |
| 5,072,900 | A | 12/1991 | Malon |
| 5,129,605 | A | 7/1992 | Burns et al. |
| 5,177,685 | A | 1/1993 | Davis et al. |
| 5,332,180 | A | 7/1994 | Peterson et al. |
| 5,340,062 | A | 8/1994 | Heggestad |
| 5,364,047 | A | 11/1994 | Petit et al. |
| 5,394,333 | A | 2/1995 | Kao |
| 5,398,894 | A | 3/1995 | Pascoe |
| 5,452,870 | A | 9/1995 | Heggestad |
| 5,533,695 | A | 7/1996 | Heggestad et al. |
| 5,620,155 | A | 4/1997 | Michalek |

(Continued)

OTHER PUBLICATIONS

U.S. Appl. No. 10/267,959, filed Oct. 10, 2002, Pending.
U.S. Appl. No. 10/157,874, filed May 31, 2002, Pending.
U.S. Appl. No. 10/186,426, filed Jul. 2, 2002, Pending.
U.S. Appl. No. 10/184,929, filed Jul. 1, 2002, Pending.
U.S. Appl. No. 10/267,962, filed Oct. 10, 2002, Pending.
U.S. Appl. No. 10/331,768, filed Dec. 31, 2002, Pending.
U.S. Appl. No. 10/300,852, filed Nov. 21, 2002, Pending.
"Testimony of Jolene M. Molitoris, Federal Railroad Administrator, U.S. Department of Transportation before the House Committee on Transportation and Infrastructure Subcommittee on Railroads", Federal Railroad Administration, United States Department of Transportation, Apr. 1, 1998.
"System Architecture, ATCS Specification 100", May 1995.
"A New World for Communications & Signaling", Progressive Railroading, May 1986.

(Continued)

*Primary Examiner*—Yonel Beaulieu
(74) *Attorney, Agent, or Firm*—DLA Piper Rudnick Gray Cary US LLP

(57) ABSTRACT

A positive signal comparator system includes a transceiver located on a train for transmitting an interrogation signal to a wayside signal device and receiving a response signal from the wayside signal device, an input device through which an operator enters a signal in response to the signal received from the wayside signal device, and a controller including a signal comparator for determining if the signal input by the operator matches the signal received from the wayside signal device and taking corrective action if the operator fails to enter the proper signal. In some embodiments, the corrective action comprises activating a warning device and/or activating the train's brakes. In some embodiments, the invention further comprises a display for displaying the signal received from the wayside signal generator to the operator.

53 Claims, 3 Drawing Sheets

U.S. PATENT DOCUMENTS

| | | | |
|---|---|---|---|
| 5,699,986 | A | 12/1997 | Welk |
| 5,740,547 | A | 4/1998 | Kull et al. |
| 5,751,569 | A | 5/1998 | Metel et al. |
| 5,803,411 | A | 9/1998 | Ackerman et al. |
| 5,828,979 | A | 10/1998 | Polivka et al. |
| 5,867,122 | A | 2/1999 | Zahm et al. |
| 5,944,768 | A | 8/1999 | Ito et al. |
| 5,950,966 | A | 9/1999 | Hungate et al. |
| 5,978,718 | A | 11/1999 | Kull |
| 5,995,881 | A | 11/1999 | Kull |
| 6,049,745 | A | 4/2000 | Douglas et al. |
| 6,081,769 | A | 6/2000 | Curtis |
| 6,102,340 | A | 8/2000 | Peek et al. |
| 6,112,142 | A | 8/2000 | Shockley et al. |
| 6,135,396 | A | 10/2000 | Whitfield et al. |
| 6,179,252 | B1 | 1/2001 | Roop et al. |
| 6,218,961 | B1 | 4/2001 | Gross et al. |
| 6,311,109 | B1 | 10/2001 | Hawthorne et al. |
| 6,322,025 | B1 | 11/2001 | Colbert et al. |
| 6,345,233 | B1 | 2/2002 | Erick |
| 6,371,416 | B1 | 4/2002 | Hawthorne |
| 6,373,403 | B1 | 4/2002 | Korver et al. |
| 6,374,184 | B1 | 4/2002 | Zahm et al. |
| 6,377,877 | B1 | 4/2002 | Doner |
| 6,397,147 | B1 | 5/2002 | Whithead |
| 6,421,587 | B2 | 7/2002 | Diana et al. |
| 6,456,937 | B1 | 9/2002 | Doner et al. |
| 6,459,964 | B1 | 10/2002 | Vu et al. |
| 6,459,965 | B1 | 10/2002 | Polivka et al. |
| 6,487,478 | B1 | 11/2002 | Azzaro et al. |
| 2001/0056544 | A1 | 12/2001 | Walker |
| 2002/0070879 | A1 | 6/2002 | Gazit et al. |

OTHER PUBLICATIONS

"Advanced Train Control Gain Momentum", Progressive Railroading, Mar. 1986.
"Railroads Take High Tech in Stride", Progressive Railroading, May 1985.
Lyle, Denise, "Positive Train Control on CSXT", Railway Fuel and Operating Officers Association, Annual Proceedings, 2000.
Lindsey, Ron A., "C B T M, Communications Based Train Management", Railway Fuel and Operating Officers Association, Annual Proceedings, 1999.
Moody, Howard G, "Advanced Train Control Systems A System to Manage Railroad Operations", Railway Fuel and Operating Officers Association, Annual Proceedings, 1993.
Ruegg, G.A., "Advanced Train Control Systems ATCS", Railway Fuel and Operating Officers Association, Annual Proceedings, 1986.
Malone, Frank, "The Gaps Start to Close"Progressive Railroading, May 1987.
"On the Threshold of ATCS", Progressive Railroading, Dec. 1987.
"CP Advances in Train Control", Progressive Railroading, Sep. 1987.
"Communications/Signaling: Vital for dramatic railroad advances", Progressive Railroading, May 1988.
"ATCS's System Engineer", Progressive Railroading, Jul. 1988.
"The Electronic Railroad Emerges", Progressive Railroading, May 1989.
"$C^3$ Comes to the Railroads", Progressive Railroading, Sep. 1989.
"ATCS on Verge of Implementation", Progressive Railroading, Dec. 1989.
"ATCS Evolving on Railroads", Progressive Railroading, Dec. 1992.
"High Tech Advances Keep Railroads Rolling", Progressive Railroading, May 1994.
"FRA Promotes Technology to Avoid Train–To–Train Collisions", Progressive Railroading, Aug. 1994.
"ATCS Moving slowly but Steadily from Lab for Field", Progressive Railroading, Dec. 1994.
Judge, T., "Electronic Advances Keeping Railroads Rolling", Progressive Railroading, Jun. 1995.
"Electronic Advances Improve How Railroads Manage", Progressive Railroading, Dec. 1995.
Judge, T., "BNSF/UP PTS Pilot Advances in Northwest", Progressive Railroading, May 1996.
Foran, P., "Train Control Quandary, Is CBTC viable? Railroads, Suppliers Hope Pilot Projects Provide Clues", Progressive Railroading, Jun. 1997.
"PTS Would've Prevented Silver Spring Crash: NTSB", Progressive Railroading, Jul. 1997.
Foran, P., " A 'Positive' Answer to the Interoperability Call", Progressive Railroading, Sep. 1997.
Foran, P., "How Safe is Safe Enough?", Progressive Railroading, Oct. 1997.
Foran, P., " A Controlling Interest In Interoperability", Progressive Railroading, Apr. 1998.
Derocher, Robert J., "Transit Projects Setting Pace for Train Control", Progressive Railroading, Jun. 1998.
Kube, K., "Variations on a Theme", Progressive Railroading, Dec. 2001.
Kube, K., "Innovation in Inches", Progressive Railroading, Feb. 2002.
Vantuono, W., "New York Leads a Revolution", Railway Age, Sep. 1996.
Vantuono, W., "Do you know where your train is?", Railway Age, Feb. 1996.
Gallamore, R., "The Curtain Rises on the Next Generation", Railway Age, Jul. 1998.
Burke, J., "How R&D is Shaping the 21st Century Railroad", Railway Age, Aug. 1998.
Vantuono, W., "CBTC: A Maturing Technology", Third International Conference On Communications Based Train Control, Railway Age, Jun. 1999.
Sullivan, T., "PTC—Is FRA Pushing Too Hard?", Railway Age, Aug. 1999.
Sullivan, T., "PTC: A Maturing Technology", Railway Age, Apr. 2000.
Moore, W., "How CBTC Can Increase Capacity", Railway Age, Apr. 2001.
Vantuono, W., "CBTC: The Jury is Still Out", Railway Age, Jun. 2001.
Vantuono, W., "New–tech Train Control Takes Off", Railway Age, May 2002.
Union Switch & Signal Intermittent Cab Signal, Bulletin 53, 1998.
GE Harris Product Sheet: "Advanced Systems for Optimizing Rail Performance" and " Advanced Products for Optimizing train Performance", undated.
GE Harris Product Sheet: "Advanced, Satellite–Based Warning System Enhances Operating Safety", undated.
Furman, E., et al., "Keeping Track of RF", GPS World, Feb. 2001.
Department of Transportation Federal Railroad Administration, Federal Register, vol. 66, No. 155, pp. 42352–42396, Aug. 10, 2001.

POSITIVE SIGNAL COMPARATOR AND METHOD

BACKGROUND OF THE INVENTION

1. Field of the Invention

The present invention relates to wayside signaling generally and more particularly to wayside signal acknowledgment systems.

2. Description of Related Art

A wide variety of wayside signal systems are known to the prior art. Traditional wayside signaling systems comprise one or more colored signal lights that are mounted on poles alongside a train track at various locations such as near the beginning of a block of track or near grade crossings, sidings, switches, etc. The signal lights indicate such things as speed restrictions and the status of the next block of track. On some railroads there are over 125 different colored light signal indications that must be recognized and obeyed. An engineer/operator is required to observe the lights and operate the train accordingly. However, because engineers/operators are human, mistakes which can cause serious accidents are sometimes made. Such mistakes include the failure to observe signal lights and misinterpretation as to the meaning of the signal lights.

Several known systems address this problem in one form or another. For example, a system described in U.S. Pat. No. 6,112,142 (the contents of which are hereby incorporated by reference herein), which is owned by the assignee of the present invention, provides a signal comparator system and method in which and engineer and a trainman are each provided with a combined display/input device referred to therein as a pendant. In that system, both the engineer and the trainman must agree, by pressing corresponding buttons on the pendant, as to the meaning of the signal as indicated by the lights. If both the engineer and the trainman agree as to the meaning of the signal, that system will automatically enforce any restrictions corresponding to the signal. If the engineer and the trainman do not agree as to the meaning of the signal, or do not obey any restrictions corresponding to the signal (e.g., the signal indicates stop, but the brakes are not activated), the system will take corrective action to enforce the signal and/or stop the train. However, this system, while providing several advantages over other known systems, has some drawbacks. First, it requires the presence of both an engineer and a trainman. Second, it is susceptible to error or intentional defeat by an engineer and a trainman who enter (accidentally or purposely) the wrong signal information.

In another known system, referred to as Cab Signal, a display is provided in the cab for the engineer/operator and wayside signals are transmitted to the system and shown on the display. The Cab Signal system forces the engineer/operator to acknowledge signals that are more restrictive than the current signal and, in some systems, forces the engineer/operator to obey the more restrictive signal. However, this system does not force an engineer/operator to acknowledge less restrictive signals. This is disadvantageous because if an engineer/operator misses a less restrictive signal, the engineer/operator may miss an opportunity to operate the train more efficiently by increasing the speed of the train.

What is needed is a system and method that overcomes these and other deficiencies in known systems.

BRIEF SUMMARY OF THE INVENTION

The present invention meets the aforementioned need to a great extent by providing a positive signal comparator system comprising a transceiver located on a train for transmitting an interrogation signal to a wayside signal device and receiving a response signal from the wayside signal device, an input device through which the engineer/conductor enters a signal in response to the signal received from the wayside signal device, and a controller including a signal comparator for determining if the signal input by the engineer/operator matches the signal received from the wayside signal device and taking corrective action if the engineer/operator fails to enter the proper signal. In some embodiments, the corrective action comprises activating a warning device and/or activating the train's brakes.

In some embodiments, the invention further comprises a display for displaying a signal received from the wayside signal generator to the engineer/operator. In such embodiments, the wayside signal device may or may not include signal lights or other visual indication of the signal. In other embodiments, no display of the signal is provided and the engineer/operator must rely on a visual indication of the signal from the wayside signal device.

In some embodiments, the system includes a positioning system such as a global positioning system that is used to determine the location of the train and a database in which is stored the location of all wayside signals in the system. When the controller determines that the train is near a wayside signal device, the controller automatically activates the transceiver to interrogate the device. In other embodiments, the wayside signal device automatically transmits a wayside signal when the wayside signal device detects that the train is approaching (e.g., with a track occupancy circuit), or continuously transmits a wayside signal on a periodic basis regardless of whether a train is present.

In some embodiments, after receiving a signal from a wayside signal device the controller dynamically determines the amount of time necessary to stop the train based on the train's speed, weight, and other factors and sets a timeout period by which the engineer/operator must enter a matching signal. In other embodiments, the timeout period is predetermined based on a worst-case assumption (e.g., fastest possible speed, greatest weight, steepest downhill grade of track, etc.) of the time required to stop the train. If the engineer/operator fails to enter a matching signal within the timeout period, corrective action is taken.

In some embodiments of the invention, a single pendant is provided and the controller requires only a single matching signal to be entered by an engineer/operator. In other embodiments of the invention, a second pendant is provided and the controller requires a second person such as a trainman to match the signal provided by the wayside signaling device.

In one aspect of the invention, the engineer/operator is required to match the signal transmitted by the wayside signaling device. This is an improvement over systems in which the engineer/operator is only required to acknowledge the signal (e.g., by pressing a general purpose acknowledgment button regardless of the meaning of the signal) because it ensures that the engineer/operator is alert and is not simply reflexively acknowledging the signal.

In another aspect of the invention, all signals, whether or not they are more restrictive than the previous signal, must be matched by the engineer/operator. Having the engineer/operator acknowledge less restrictive signals provides additional indication that the engineer/operator is alert.

BRIEF DESCRIPTION OF THE DRAWINGS

A more complete appreciation of the invention and many of the attendant features and advantages thereof will be readily obtained as the same become better understood by reference to the following detailed description when considered in connection with the accompanying drawings, wherein.

DETAILED DESCRIPTION

The present invention will be discussed with reference to preferred embodiments of signal comparator systems. Specific details, such as types of signals, are set forth in order to provide a thorough understanding of the present invention. The preferred embodiments discussed herein should not be understood to limit the invention. Furthermore, for ease of understanding, certain method steps are delineated as separate steps; however, these steps should not be construed as necessarily distinct nor order dependent in their performance.

Figure 1:
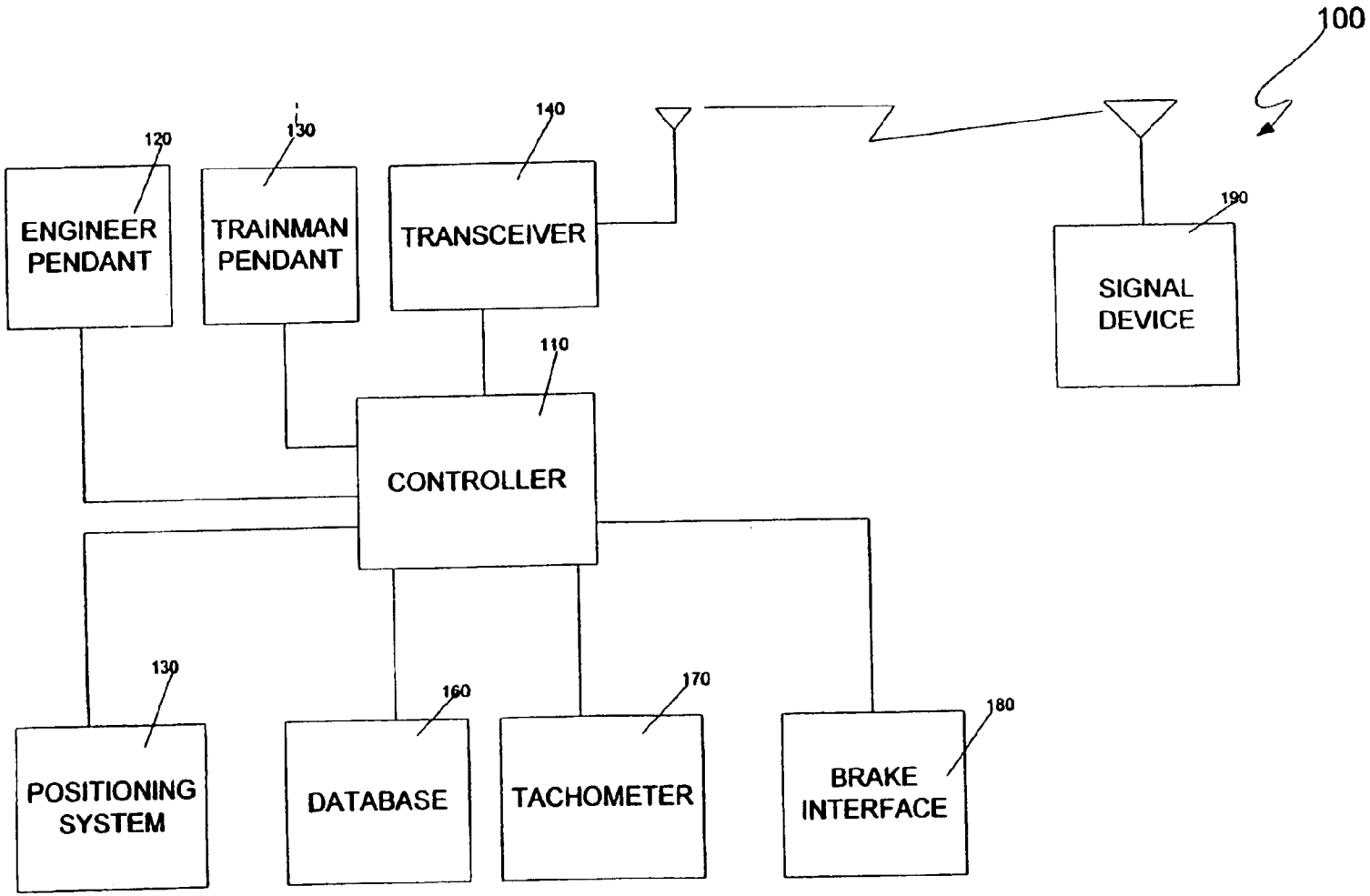
FIG. 1 is a block diagram of one embodiment of the invention.

A positive signal comparator system 100 is illustrated in FIG. 1. The system 100 includes a controller 110. The controller 110 may be a conventional microprocessor or may be implemented using discrete components. The controller 110 is responsible for implementing the logical operations discussed in detail below.

An engineer pendant 120 is connected to the controller 110. The engineer pendant 120 is illustrated in further detail in FIG. 2. The pendant 120 includes a series of 12 buttons 231–242 labeled as 1 CLR (clear), 2 LTD (limited), 3 APP (approach), 4 MED (medium), 5 DIV (diverging), 6 SLOW, 7 ADV (advance), 8 RES (restricted), 9 STOP/PROC (1 push=stop, 2 pushes=proceed), 10 COND O'RIDE (conditional override), 11 ACK/ENTER (acknowledge/enter—depends upon context); and 12 CANCEL, respectively. Buttons 231–240 correspond to various signals defined in the GCOR (General Code of Operational Rules) and various other signaling systems used in the United States. The ACK/ENTER and CANCEL buttons 241 and 242 are used to acknowledge warnings, enter information, and cancel a previous entry, respectively.

The buttons 231–242 are used by the engineer/operator (and, in embodiments with two pendants, the trainman) to acknowledge a signal from a wayside signaling device. For example, if a "medium approach medium" signal were received from the wayside signal device (which means that the train is allowed to travel at medium speed through turnouts, crossovers sidings and over power operated switches, then proceed, approaching the next signal at a speed not exceeding the medium speed), the engineer/operator would depress the MED button 234, the APP button 233, and the MED button 234 in that order to verify that the signal has been correctly received and understood by the engineer/operator.

Figure 2:
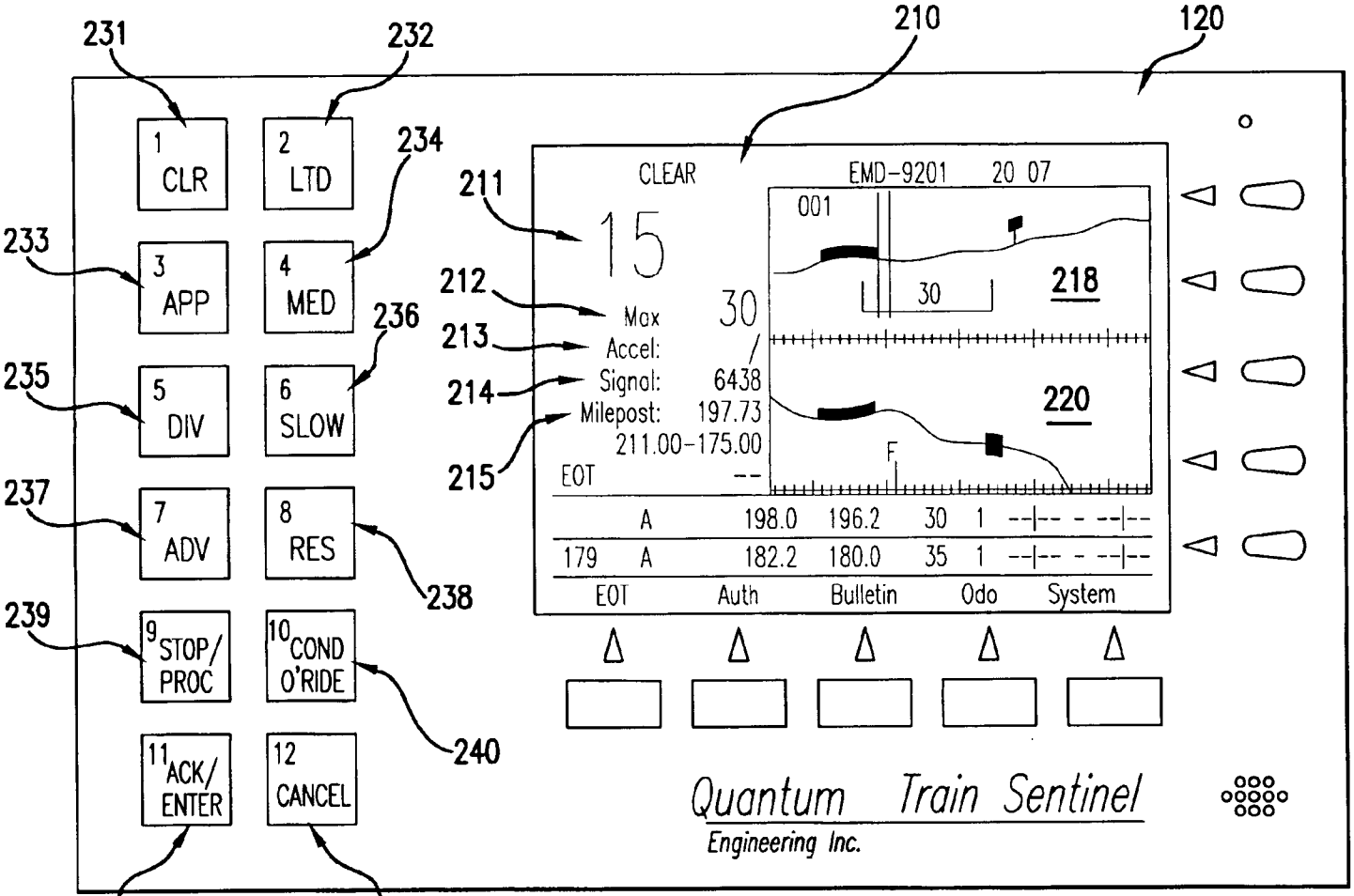
FIG. 2 is a front view of a pendant of the embodiment of FIG. 1.

The pendant 120 also includes a window 210, which is preferably a graphics-capable display (a liquid crystal display is illustrated in FIG. 2, but any graphics display could be used). The window includes a current speed field 211, a maximum speed field 212, a acceleration field 213 (which indicates the current acceleration in m.p.h. per minute), a distance to next signal field 214, a milepost field 215, an elevation profile window 218, and a track curvature window 220. The distance to next signal field 214 reads "signal 6438" in FIG. 2, which signifies that the next signal is 6,438 feet away. In some embodiments, when a signal from the next signal device is received, the word "signal" will be replaced by the meaning of signal (e.g., "clear") received from that signal device. The window 210 also displays, in fields 222 and 224, current and upcoming speed restrictions over limited areas of the track. In the example of FIG. 2, the speed restrictions are "Form A" speed restrictions, valid from mileposts 198 to 196.2 and 182.2 to 180, with maximum speeds of 35 and 30 miles per hour and no time limits, respectively. The buttons surrounding the window 210 are "soft keys" that have different, programmable functions, which are beyond the scope of the present invention, depending on the content of the display 210 in a manner well known in the art.

In embodiments of the invention in which the signal from the wayside signal device 190 is displayed to the engineer/operator, the signal may be displayed in a "pop-up" window in the window 210. In other embodiments, the signal may only be displayed next to the distance to signal field 214 as discussed above. In other embodiments, no visual indication of the signal device 190 is provided on the pendants 120, 130. Rather, in such embodiments, the engineer/operator relies on a visual indication on the signal device 190 such as colored lights.

Referring now back to FIG. 1, a transceiver 140 is also connected to the controller 110. The transceiver 140 is capable of communicating with wayside signal devices 190. The communication is wireless in preferred embodiments, although those of skill in the art will understand that other forms of communication, such as power line communication, are also possible.

Also connected to the controller 110 is a positioning system 150. The positioning system 150 is a GPS receiver in preferred embodiments. The GPS receiver can be of any type, including a differential GPS, or DGPS, receiver. Other types of positioning systems 150, such as inertial navigation systems (INSs) and Loran systems, can also be used. Such positioning systems are well known in the art and will not be discussed in further detail herein. [As used herein, the term "positioning system" refers to the portion of a positioning system that is commonly located on a mobile vehicle, which may or may not comprise the entire system. Thus, for example, in connection with a global positioning system, the term "positioning system" as used herein refers to a GPS receiver and does not include the satellites that are used to transmit information to the GPS receiver.]

The positioning system 150 continuously supplies the controller 110 with position information for the train to which the system 100 is attached. This position information allows the controller 110 to determine where the train is at any time. The positioning system 150 is preferably sufficiently accurate to unambiguously determine which of two adjacent tracks a train is on. By using train position information obtained from the positioning system 150 as an index into a map database 160 (discussed in further detail below), the controller 110 can determine the train's position relative to wayside signal devices 190 in the system. As discussed in further detail below, this allows the controller 110 to send an interrogation signal to the wayside signal device 190 at the appropriate time.

A map database 160 is also connected to the controller 110. The map database 160 preferably comprises a non-volatile memory such as a hard disk, flash memory, CD-ROM or other storage device, on which map data and the locations of wayside signal devices is stored. Other types of memory, including volatile memory, may also be used.

The map data preferably also includes positions of switches, grade crossings, stations and anything else of which a conductor or engineer is required to or should be cognizant. The map data preferably also includes information concerning the direction and grade of the track.

In addition to the positioning system 150, a tachometer 170 is also connected to the controller 110. The tachometer 170 measures the axle rotation, from which the speed of the train can be derived if the wheel size is known. In the event that the positioning system 150 becomes unavailable, the system 100 can operate by estimating distance traveled from the rotation of the axle or motor. However, wheel slippage and changes in wheel size over time can effect the accuracy of such a system. The system 100 may be configured to compensate for wheel wear in the manner described in co-pending U.S. patent application Ser. No. 10/157,874, filed May 31, 2002, entitled "Method and System for Compensating for Wheel Wear on a Train," the contents of which are hereby incorporated by reference herein.

Finally, a brake interface 180 connected to the controller 110 allows the controller 110 to activate and control the train brakes when necessary to slow and/or stop the train. Brake interfaces are well known in the art and will not be discussed in further detail herein.

Figure 3:
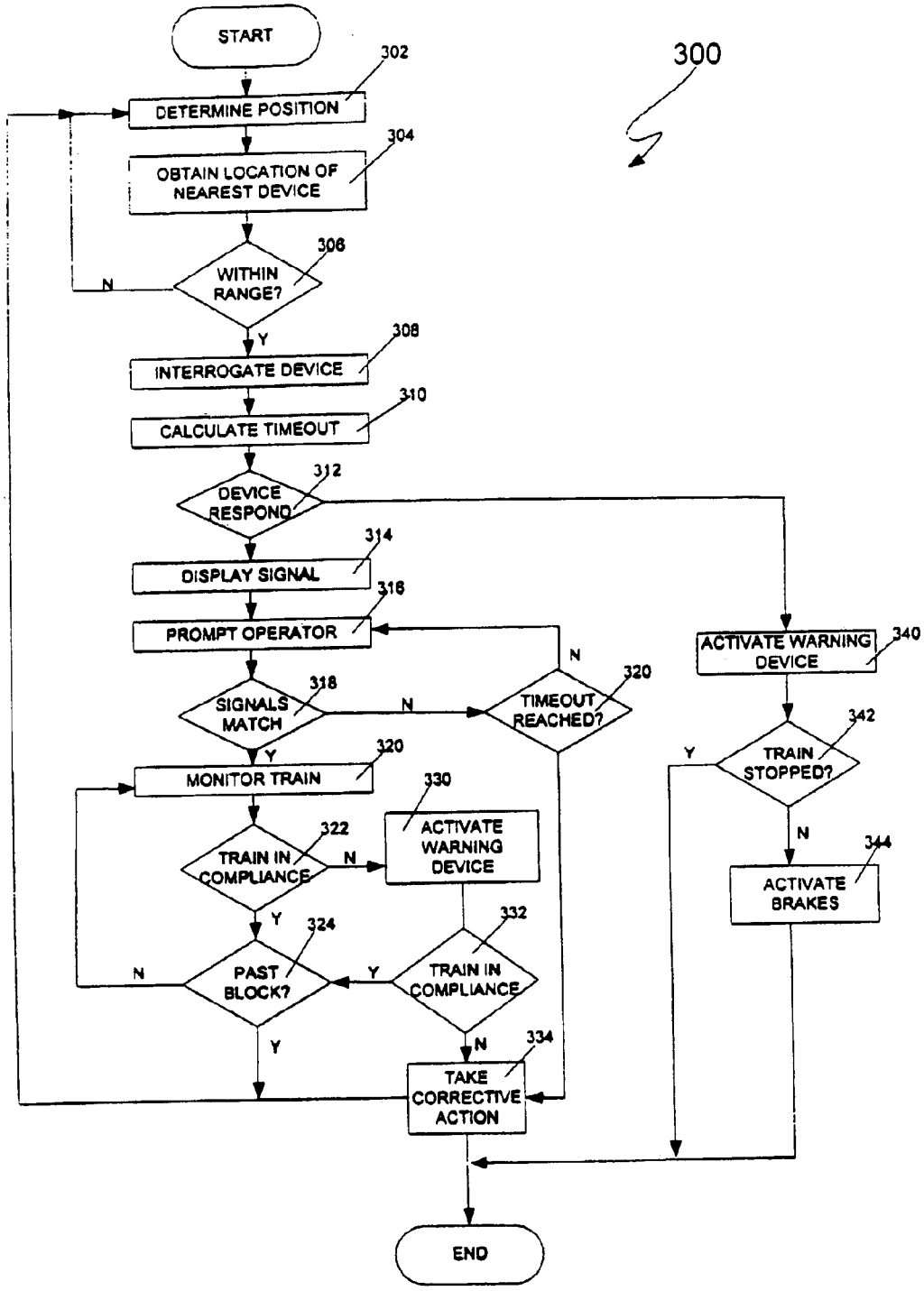
FIG. 3 is a flow chart illustrating operation of the system of FIG. 1.

A flowchart 300 illustrating operation of the system 100 is shown in FIG. 3. The process starts with the controller 110 querying the positioning system 150 (or, in some embodiments the tachometer 170 if position information from the positioning system 150 is not available) to determine the position of the train at step 302. The controller 110 then consults the database 160 to determine the nearest signaling device 190 based on the train's position at step 304. Next, the controller 110 determines whether the signaling device 190 is within the range of the transceiver 140 at step 306. If the nearest device is not within range, steps 302 and 304 are repeated until the next signaling device 190 is within range. When the next device 190 is within range, the controller 110 causes the transceiver 140 to transmit an interrogation message at step 308.

The controller then determines at step 310 a timeout within which a signal must be received from the device 190 and a matching signal must be received from the engineer's pendant 120, and, in some embodiments, from the trainman's pendant 130. The timeout is chosen such that, at the expiration of the timeout, there will be sufficient distance and time in which to stop the train in the event of a problem (e.g., the device does not respond or the signal entered by engineer and/or trainman does not match the signal received from the device). The timeout is dynamically determined in some embodiments using factors such as the speed and weight of the train, the distance between the train and the upcoming signaling device 190, the grade of the upcoming section of track, the distribution of weight on the train, and/or the characteristics of the braking system on the train using equations which are well known in the art. In other embodiments, the timeout is a fixed period based upon a worst-case assumption about the distance required If the wayside signaling device 190 responds at step 312, the received signal is displayed in some embodiments on the engineer's pendant 120, and in yet other embodiments on the trainman's pendant 130 at step 314. The controller 110 then prompts the engineer (and, in some embodiments, the trainman) to enter a matching signal at step 316. If the signal entered by the engineer (and, in some embodiments, the trainman) do not match the signal reported by the wayside device 190 via the transceiver 140 at step 318, and the timeout has not yet been reached at step 320, steps 316 and 318 will be repeated to provide the operator (and, in some embodiments, the trainman) with an additional opportunity to enter a correct matching signal. If a correct matching signal is received from the engineer's pendant 120 (and, in some embodiments, the trainman's pendant 130) at step 318, the controller then monitors the train's compliance with the signal at step 320. If the train is in compliance at step 322, but is not yet past the end of the block corresponding to the signaling device 190 at step 324, step 322 is repeated until the train is past the end of the block at step 324, at which point steps 310 et seq. are repeated.

If the train is not in compliance at step 322, the controller activates a warning device at step 330. The warning device may be a pendant 120 (130) in preferred embodiments, but also may be a horn, whistle, or other device (not shown in FIG. 1) rather than addition to the pendant 120 in other embodiments. If the train is brought into compliance at step 332, steps 324 et seq. are repeated. If the train is not brought into compliance at step 332, corrective action is taken at step 334. The types of corrective action can include applying a penalty braking algorithm, which will stop the train; notifying a dispatcher (in embodiments that provide for communication between the system 100 and a dispatcher); and slowing the train down to a predetermined safe speed to allow the engineer to visually verify that it is safe to proceed.

If the device 190 fails to respond within the timeout period at step 312, the controller activates a warning device at step 340. The controller determines whether the train is stopped (or, in other embodiments, has slowed down to a safe speed) at step 342. If the train has not been stopped (or slowed down) at step 342, the brakes are activated at step 344. The process then ends. At this point, some embodiments of the system require authorization from a dispatcher in order to start the train moving again. Other embodiments require the engineer/operator to perform a start up procedure. Yet other embodiments simply require a full stop before further movement is allowed.

In some embodiments, the system will become "active" anytime (1) any switch button is used or (2) anytime the speed of the locomotive is greater than 15 mph. These features make the system unobtrusive during railyard switching operations. Also, when speed increases above 15 mph the system will require an initial acknowledgment between the engineer and trainman. This feature provides for positive indication that the system is operational and functioning properly. After this initial acknowledgment the system will require engineer/trainman acknowledgments at set intervals mandatorily such as one (1) hour between pendant activity as long as the train speed is above 15 mph and no signal button has been depressed in the last hour. In the event that speed is reduced to a "stop" and then increased to greater than 15 mph without any intervening button operation, the system will "force" an acknowledgment to further check the system and the crew's actions.

As discussed above, compliance with the signal from the wayside signaling device 190 is monitored at step 322. An example of non-compliance is if the speed of the train exceeds the "target" speed for a given signal by a prescribed speed over the target speed and the train is not decelerating, at a target deceleration amount (e.g., 1 mph/min). In some embodiments, if an initial determination of non-compliance is made, a response timer will be set and automatic braking will occur upon timeout of the response timer unless (1) the speed of the train is reduced to less than 5 mph above the "target speed"; (2) the train is decelerating at an acceptable rate; or (3) the speed of the train is brought below the "target speed".

In addition to ensuring compliance with wayside signaling devices 190, the system 100 may also insure compliance with "slow order" or speed restriction information for the territory to be traversed by the train. In such embodiments, "slow order"/speed restriction information is stored in the database 160 and is treated in a manner similar to signals from wayside devices 190 (e.g., when the train approaches the start of a section of track covered by a slow order or speed restriction, the slow order/speed restriction information is displayed to an engineer (and, optionally, a trainman) on the pendant 120 in a "pop up" window, and the controller 110 takes corrective action if a matching signal is not entered by the engineer/trainman and/or if the slow order/speed restriction is not complied with.)

Several methods for updating the "slow order"/speed restriction information are available including:

A. Operator Update:

The train crew must "sign up" before boarding the train. The operator can be given a credit card sized memory device or some similar device having the latest track information at the "sign up" location. After receiving this data, a crewman can board the train and read this latest data into the database 160.

B. Radio Update:

At prescribed railroad locations, a low power transmitter can be employed to automatically update the database 160 (which may or may not be accomplished using transceiver 140). Additionally, an existing RF infrastructure of the rail system could be employed to update all locomotives with new data.

C. Computer Update:

During mechanical inspections, a laptop or other memory device could be used to update the database 160. In such embodiments, the pendant 120, 130 preferably displays the date the system was last updated the crew can verify that they have the latest data.

In preferred embodiments, each wayside signal device 190 has a unique telemetry identifier. Therefore only the particular signal in advance of the train is interrogated. This information is telemetered to the system 100 and displayed to the crew, which may be only one member. As the train travels closer to the signal, updates of the signal indication are sent to the train to ensure the signal does not change during this period. When the train is within 1500 feet (for example), the crew is forced to acknowledge exactly the signal indication. Should the crew member(s) not correctly acknowledge the signal, the system will automatically stop the train. Additionally, as with the prior system, the speed limit as defined by the signal indication is automatically enforced upon the train.

In some embodiments, no interrogation signal is sent by the train to the wayside signal device. In some of these embodiments, the wayside signal device may employ a track occupancy circuit or some other means (e.g., radar) to detect the presence of an approaching train and automatically transmit a message including the wayside signal to such an approaching train. In yet other embodiments, which are particularly useful when the wayside signal device is located near a source of power, the wayside signal device periodically broadcasts a wayside signal without regard to whether or not a train is approaching. In still other embodiments, the train's position and (optionally) speed information are transmitted to a central dispatch authority and the central dispatch authority instructs the wayside signal device to transmit a signal to the train as it approaches the device. The wayside signal device in these alternative embodiments may or may not include an identification of the device in the message along with the wayside signal. Those of skill in the art will recognize that a system may include a combination of some or all of these types of wayside signal devices (e.g., those that transmit a wayside signal upon receiving an interrogation message, those that transmit a wayside signal in response to detecting an approaching train, those that automatically transmit a wayside without regard to whether or not a train is approaching, and those that transmit a wayside signal under the control of a central dispatch authority).

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed is:

1. A positive signal comparator system comprising:

a controller located on a train;

a first transmitter connected to the controller for transmitting an interrogation signal to a wayside signal device under the control of the controller;

a wayside signal device including a first receiver for receiving the interrogation signal and a second transmitter for transmitting a wayside signal in response to the interrogation signal;

a second receiver connected to the controller for receiving the wayside signal;

a first input device connected to the controller, the first input device accepting a first signal from an operator of the train and providing the first signal to the controller;

wherein the controller is configured to compare the first signal to the wayside signal and take corrective action if the first signal does not match the wayside signal.

2. The system of claim 1, further comprising:

a brake interface connected to the controller, the brake interface being configured to operate a brake on the train in response to a control signal from the controller;

wherein the corrective action includes generating the control signal.

3. The system of claim 1, further comprising:

a warning device connected to the controller;

wherein the corrective action includes activating the warning device.

4. The system of claim 1, wherein the warning device is an audible warning device.

5. The system of claim 1, wherein the warning device is a display.

6. The system of claim 1, wherein the controller is further configured to take corrective action if a wayside signal is not received from the second transmitter of the wayside signal device within a timeout period.

7. The system of claim 1, wherein the controller is configured to take corrective action if a first signal from the first input device is not received within a timeout period.

8. The system of claim 1, further comprising:

a first display device connected to the controller;

wherein the control is further configured to display the wayside signal on the first display device.

9. The system of claim 1, further comprising:

a second input device, the second input device accepting a second signal from a second person on the train and providing the second signal to the controller;

wherein the controller is further configured to compare the second signal to the wayside signal and take corrective action if the second signal does not match the wayside signal.

10. The system of claim 9, further comprising:

a second display device connected to the controller;

wherein the controller is further configured to display the wayside signal on the second display device.

11. The system of claim 10, wherein the first input device and the first display device are integrated into a first pendant, and the second input device and the second display device are integrated into a second pendant.

12. The system of claim 1, further comprising:

a database connected to the controller, the database including location information for at least one wayside signal device;

wherein the controller is configured to retrieve the location information from the database and use the location information to determine when to transmit the interrogation signal.

13. The system of claim 1, further comprising a positioning system connected to the controller for providing position information of the train to the controller;

wherein the positioning system is configured to utilize the position information for determining when to transmit the interrogation signal.

14. The system of claim 13, wherein the positioning system is a global positioning system.

15. The system of claim 14, wherein the global positioning system is a differential global positioning system.

16. The system of claim 13, further comprising a tachometer connected to the controller, the tachometer being configured to output rotation information for a train wheel, wherein the controller is configured to use the rotation information if position information from the global positioning system is not available.

17. A method for operating a train comprising the steps of:

determining when a train is near a wayside signal device;

transmitting an interrogation signal from the train to the wayside signal device when the train is near the wayside signal device;

receiving a wayside signal from the wayside signal device in response to the interrogation signal;

accepting a first signal from an operator of the train;

comparing the first signal to the wayside signal;

taking corrective action if the first signal does not match the wayside signal.

18. The method of claim 17, wherein the corrective action includes activating a brake on the train.

19. The method of claim 17, wherein the corrective action includes activating a warning device on the train.

20. The method of claim 19, wherein the warning device is an audible warning device.

21. The method of claim 19, wherein the warning device is a visual warning device.

22. The method of claim 17, further comprising the step of displaying the wayside signal on a display device.

23. The method of claim 17, further comprising the step of taking corrective action if a wayside signal is not received from the wayside signal device within a timeout period.

24. The method of claim 17, further comprising the step of taking corrective action if a first signal is not received within a timeout period.

25. The method of claim 17, wherein the determining step is performed by obtaining location information corresponding to the wayside signal device from a database, obtaining position information corresponding to the train; and calculating a distance from the train to the wayside signal device using the position information and the location information.

26. The method of claim 25, wherein the position information is obtained from a positioning system.

27. The method of claim 26, wherein the positioning system is a global positioning system.

28. The method of claim 25, wherein the position information is obtained using information from a tachometer configured to measure rotation information for a wheel on the train.

29. The method of claim 17, further comprising the steps of:

accepting a second signal from a second person on the train;

comparing the second signal to the wayside signal; and taking corrective action if the second signal and the wayside signal do not match.

30. The method of claim 29, further comprising the step of displaying the wayside signal on a second display associated with the second person.

31. A positive signal comparator system comprising:

a controller located on a train;

a receiver connected to the controller for receiving a wayside signal from a wayside signal device; and an input device connected to the controller, the input device accepting a first signal from an operator of the train and providing the first signal to the controller;

wherein the controller is configured to compare the first signal to the wayside signal and take corrective action if the first signal does not match the wayside signal.

32. The system of claim 31, further comprising a transmitter connected to the controller for transmitting an interrogation signal to a wayside signal device under the control of the controller.

33. The system of claim 32, wherein the transmitter and receiver are radio frequency devices.

34. The system of claim 33, further comprising a plurality of wayside signal devices, each of the wayside signal devices including a radio frequency transceiver, each of the radio frequency transceivers being configured to transmit at a same frequency, each of the wayside signal devices being configured to transmit an identification number along with a wayside signal in response to an interrogation signal.

35. The system of claim 34, wherein the interrogation signal includes an identification number corresponding to a wayside signal device for which the interrogation signal is directed.

36. The system of claim 31, further comprising a display device connected to the controller, wherein the controller is configured to display the signal on the display device.

37. The system of claim 31, wherein the controller is configured to calculate a timeout period during which a first signal that matches the wayside signal must be received, the timeout period being based at least in part on a speed of the train and a distance between the train and the wayside signal device.

38. The system of claim 37, wherein the timeout period is further based on a weight of the train.

39. The system of claim 31, wherein the corrective action comprises activating a brake on the train.

40. The system of claim 39, wherein the brake is activated to stop the train.

41. The system of claim 40, wherein the controller is further configured to prevent the train from continuing until permission is received from a dispatcher.

42. The system of claim 31, wherein the controller does not become active until a speed of the train exceeds a threshold speed.

43. The system of claim 31, further comprising a database connected to the controller, wherein the database includes speed restriction information and the controller is configured to retrieve the speed restriction information from the database and take corrective action if a speed of the train exceeds a maximum speed indicated by the speed restriction information.

44. A method for ensuring that a train is operated in accordance with a wayside signal comprising the steps of:

taking corrective action whenever if the first signal does not match the wayside signal;

receiving a wayside signal from the wayside signal device;

accepting a first signal from an operator of the train;

comparing the first signal to the wayside signal;

taking corrective action if the first signal does not match the wayside signal.

45. The method of claim 44, further comprising the steps of:

determining when a train is near a wayside signal device; and transmitting an interrogation signal from the train to the wayside signal device when the train is near the wayside signal device.

46. The method of claim 45, wherein the interrogation signal includes an identification number corresponding to a wayside signal device for which the interrogation signal is directed.

47. The method of claim 44, further comprising the step of displaying the wayside signal on the display device.

48. The method of claim 44, further comprising the step of calculating a timeout period during which a first signal that matches the wayside signal must be received, the timeout period being based at least in part on a speed of the train and a distance between the train and the wayside signal device.

49. The method of claim 48, wherein the timeout period is further based on a weight of the train.

50. The method of claim 44, wherein the corrective action comprises activating a brake on the train.

51. The method of claim 50, wherein the brake is activated to stop the train.

52. The method of claim 44, further comprising the step of preventing the train from continuing until permission to continue is received from a dispatcher.

53. The method of claim 44, wherein the step of taking corrective action includes providing the operator with a second opportunity to enter a signal that matches the wayside signal.

* * * * *

UNITED STATES PATENT AND TRADEMARK OFFICE

CERTIFICATE OF CORRECTION

PATENT NO. : 6,957,131 B2
APPLICATION NO. : 10/300852
DATED : October 18, 2005
INVENTOR(S) : Mark Edward Kane et al.

It is certified that error appears in the above-identified patent and that said Letters Patent is hereby corrected as shown below:

Column 8:
Claim 4,
"The system of claim 1, wherein the warning device is an audible warning device." to
--The system of claim 3, wherein the warning device is an audible warning device.--

Claim 5,
"The system of claim 1, wherein the warning device is a display." to
--The system of claim 3, wherein the warning device is a display.--

Column 9:
Claim 9,
"The system of claim 1, further comprising:" to
--The system of claim 8, further comprising:--

Claim 16,
"The system of claim 13, further comprising a tachometer connected" to
--The system of claim 14, further comprising a tachometer connected--

Column 12:
Claim 47,
"The method of claim 44, further comprising the step of displaying the wayside signal on the display device." to
--The method of claim 44, further comprising the step of displaying the wayside signal on a display device.--

Signed and Sealed this

Thirteenth Day of January, 2009

JON W. DUDAS
*Director of the United States Patent and Trademark Office*

UNITED STATES PATENT AND TRADEMARK OFFICE

CERTIFICATE OF CORRECTION

PATENT NO. : 6,957,131 B2
APPLICATION NO. : 10/300852
DATED : October 18, 2005
INVENTOR(S) : Mark Edward Kane et al.

It is certified that error appears in the above-identified patent and that said Letters Patent is hereby corrected as shown below:

Column 8:
Claim 4, lines 47 and 48
"The system of claim 1, wherein the warning device is an audible warning device." to
--The system of claim 3, wherein the warning device is an audible warning device.--

Claim 5, lines 49 and 50
"The system of claim 1, wherein the warning device is a display." to
--The system of claim 3, wherein the warning device is a display.--

Column 8:
Claim 9, line 62
"The system of claim 1, further comprising:" to
--The system of claim 8, further comprising:--

Claim 16, lines 30 and 31
"The system of claim 13, further comprising a tachometer connected" to
--The system of claim 14, further comprising a tachometer connected--

Column 12:
Claim 47, lines 1 and 2
"The method of claim 44, further comprising the step of displaying the wayside signal on the display device." to
--The method of claim 44, further comprising the step of displaying the wayside signal on a display device.--

This certificate supersedes the Certificate of Correction issued January 13, 2009.

Signed and Sealed this

Third Day of February, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 6,957,131 B2
APPLICATION NO. : 10/300852
DATED : October 18, 2005
INVENTOR(S) : Mark Edward Kane et al.

It is certified that error appears in the above-identified patent and that said Letters Patent is hereby corrected as shown below:

Column 11, lines 10-11,

"taking corrective action whenever if the first signal does not match the wayside signal;" should be removed.

Column 11, lines 15-16,

"taking corrective action if the first signal does not match the wayside signal" to --taking corrective action whenever the first signal does not match the wayside signal--.

Signed and Sealed this

Thirty-first Day of March, 2009

John Doll

JOHN DOLL
*Acting Director of the United States Patent and Trademark Office*